US009565942B2

(12) United States Patent
Eustaquio et al.

(10) Patent No.: US 9,565,942 B2
(45) Date of Patent: Feb. 14, 2017

(54) MOUNTING ASSEMBLIES FOR A GAMING DEVICE AND ASSOCIATED METHODS

(71) Applicant: IGT, Reno, NV (US)

(72) Inventors: Mindy V. Eustaquio, Reno, NV (US); Patrick J. Nohr, Reno, NV (US); John L. Beadell, Sparks, NV (US); Bradley A. Hemerick, Sparks, NV (US)

(73) Assignee: IGT, Reno, NV (US)

( * ) Notice: Subject to any disclaimer, the term of this patent is extended or adjusted under 35 U.S.C. 154(b) by 779 days.

(21) Appl. No.: 13/748,998

(22) Filed: Jan. 24, 2013

(65) Prior Publication Data

US 2014/0206457 A1 Jul. 24, 2014

(51) Int. Cl.

| | |
|---|---|
| ***A63F 9/24*** | (2006.01) |
| ***A47B 96/06*** | (2006.01) |
| ***G07F 17/32*** | (2006.01) |

(52) U.S. Cl.

CPC ..... *A47B 96/06* (2013.01); *G07F 17/32* (2013.01); *G07F 17/3216* (2013.01); *A47B 2220/0036* (2013.01); *Y10T 29/49778* (2015.01)

(58) Field of Classification Search

CPC .. G07F 17/32; G07F 17/3202; G07F 17/3216; A63F 13/08; A63F 2300/1043; A63F 13/24; A63F 13/245

USPC ..... 463/46; 273/138.1, 148 R, 309, 148 B

See application file for complete search history.

(56) References Cited

U.S. PATENT DOCUMENTS

| | | | | |
|---|---|---|---|---|
| 5,806,258 | A * | 9/1998 | Miedema | E04B 2/7437 52/220.7 |
| 6,820,875 | B1 * | 11/2004 | Hedrick et al. | 273/138.1 |
| 8,651,963 | B1 * | 2/2014 | Thompson | 463/46 |
| 2004/0018866 | A1 * | 1/2004 | Inoue | G07F 17/3213 463/16 |
| 2004/0142752 | A1 * | 7/2004 | Gauselmann | 463/46 |
| 2008/0119263 | A1 * | 5/2008 | Haga | G07F 17/3213 463/20 |
| 2012/0058830 | A1 * | 3/2012 | Vollmann | 463/47 |

* cited by examiner

*Primary Examiner* — William H McCulloch, Jr.
*Assistant Examiner* — Chase Leichliter
(74) *Attorney, Agent, or Firm* — Griffiths & Seaton PLLC

(57) ABSTRACT

A mounting bracket includes a substantially planar panel defining a first edge, a second edge opposite the first edge, a first surface, and a second surface opposite the first surface. The substantially planar panel defines a tapered slot open at the first edge, extending from the first edge toward the second edge, and terminating in a slot apex opposite the first edge. A bracket receptor includes an annular projection and a shaft extending from the annular projection. The annular projection extends beyond one or more sides of the shaft. The shaft of the bracket receptor is selectively positioned within the slot apex of the mounting bracket such that the annular projection of the bracket receptor is positioned adjacent the first surface of the substantially planar panel and the shaft of the bracket receptor extends beyond the second surface of the substantially planar panel.

17 Claims, 10 Drawing Sheets

MOUNTING ASSEMBLIES FOR A GAMING DEVICE AND ASSOCIATED METHODS

COPYRIGHT NOTICE

A portion of the disclosure of this patent document contains or may contain material, which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND OF THE INVENTION

Field of the Invention

The present invention relates in general to gaming devices and systems, and more particularly to new and improved mounting assemblies/systems for a gaming device.

Description of the Related Art

Games of chance have been enjoyed by people for many years and have undergone increased and widespread popularity in recent times. As with most forms of entertainment, some players enjoy playing a single favorite game, while others prefer playing a wide variety of games. Gaming devices are often used in casinos or other gaming venues to present one or more styles and options of games. In response to the diverse range of player preferences, gaming establishments commonly offer many types of gaming devices, such as slot and video machines. Slot and video machines have a wide variety of configurations. Commonly, however, these machines comprise upright cabinets or housings, to which the gaming machine is secured. The upright cabinets are then secured to a supporting stand. The upright cabinets and supporting stands are designed to structurally support the gaming machines, bring the gaming machines to a certain optimum height, and house supporting hardware, among other purposes.

Gaming devices, as well as the gaming device cabinets that support and/or enclose the devices themselves and the supporting stands, have evolved to become somewhat standardized in an effort to reduce manufacturing, installation, and other costs associated with implementation in gaming environments. In other words, a variety of gaming devices and supporting hardware are maintained within or otherwise associated with gaming cabinets and supporting stands. Such supporting hardware may include processing devices including controllers, video displays, lights and other display functions, buttons, a coin hopper, bill validator and cash box, and/or a wide range of other components. In some gaming locations, banks of gaming devices may be found that are each secured to these cabinets and their associated stands and are located, in some cases, in rows opposing one another. Back-to-back positioning of gaming devices often complicates installation, more particularly, securement of the associated cabinets near rear areas of the cabinets, which can be difficult to access during installation.

As one may expect, operators and vendors of gaming environments may need to relocate a particular gaming machine to another location in a particular venue, or may need to otherwise remove a gaming machine from a current location for service and/or repair. The relocation or removal and replacement of these gaming machines may take place many times during the course of the operating lifetime of a particular gaming machine. Installation and/or removal time is often lengthy, and exposes many components to potential damage or misplacement. Also, service, maintenance, and/or repair of the gaming devices may be difficult due to limited accessibility to the mounting components. Difficult to reach mounting locations also limit the type of tools used to secure the gaming device and may compromise any needed torque for safely and securing the gaming cabinet in the desired position. Technicians are also prone to injury trying to access difficult to reach mounting components. In some cases, to reach the mounting components, various other supporting components in the cabinets and stands such as power supplies, processing devices, hoppers, and power distribution components must be relocated and/or moved or removed and replaced, potentially adding to the time and complexity involved in installing gaming devices, servicing, or relocating gaming devices.

A current challenge for operators and vendors of gaming venues, in view of increasingly popular use by players, an increasing number of gaming machines, tables and the like in gaming environments, and the increasing mobility of gaming devices in and between venues, is the mounting of a gaming device in a quick, safe, and convenient manner, without jeopardizing safety to players, staff personnel, and/or field technicians, yet not requiring additional hardware associated with the mounting process that adds to the overall costs associated with such installation. A need exists for a mechanism that complements the increasing standardization of gaming machines, cabinets, and associated supporting stands, promotes safety and accessibility, and minimizes costs associated with the removal, relocation and replacement of gaming machines.

SUMMARY OF THE DESCRIBED EMBODIMENTS

To address installation issues such as the difficult assembly issues and potential safety concerns previously mentioned, in one embodiment, by way of example only, a mounting assembly is provided for mounting a gaming device to a gaming cabinet or similar support structure, providing for slidable coupling between cabinet and an associated support platform or other surface. More particularly, sliding a cabinet over a support surface and into a desired position includes sliding a bracket to receive a shaft of a corresponding bracket receptor to at least partially secure the cabinet in place on the support surface in a manner lessening an amount of installer access to hard to reach portions of the cabinet.

In one example, the mounting assembly includes a mounting bracket having a substantially planar panel defining a first edge, a second edge opposite the first edge, a first surface, and a second surface opposite the first surface. The substantially planar panel defines a tapered slot open at the first edge, extending from the first edge toward the second edge, and terminating in a slot apex opposite the first edge. A bracket receptor includes a plate and a shaft extending from the plate. The plate extends beyond one or more sides of the shaft. The shaft of the bracket receptor is selectively positioned within the slot apex of the mounting bracket such that the plate of the bracket receptor is positioned adjacent the first surface of the substantially planar panel and the shaft of the bracket receptor extends beyond the second surface of the substantially planar panel. Other apparatus, assemblies, and associated methods are also disclosed.

The foregoing Summary has been provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict embodiments of the invention and are not therefore to be considered to be limiting of its scope, the invention will be described and explained with additional specificity and detail through the use of the accompanying drawings, in which.

DETAILED DESCRIPTION OF THE DRAWINGS

The following detailed description of the invention merely provides exemplary embodiments and is not intended to limit the invention or the application and uses of the invention. Furthermore, there is no intention to be bound by any theory presented in the preceding background of the invention or the following detailed description of the invention.

The illustrated embodiments provide solutions to the aforementioned challenges facing vendors and operators of gaming venues of the necessity of a safe, convenient and cost-effective mounting mechanism for gaming machines to gaming cabinets and related support structures. The various embodiments as described below, promote safety, convenience, accessibility, and reduce cost, all in an effort to provide a standardized mounting solution in gaming environments. Thus, in one embodiment, a mounting bracket is provided that includes a substantially planar panel defining a first edge, a second edge opposite the first edge, a first surface, and a second surface opposite the first surface. The substantially planar panel defines a tapered slot open at the first edge, extending from the first edge toward the second edge, and terminating in a slot apex opposite the first edge. A bracket receptor includes an annular projection and a shaft extending from the annular projection. The annular projection extends beyond one or more sides of the shaft. The shaft of the bracket receptor is selectively positioned within the slot apex of the mounting bracket such that the annular projection of the bracket receptor is positioned adjacent the first surface of the substantially planar panel and the shaft of the bracket receptor extends beyond the second surface of the substantially planar panel.

Figure 1:
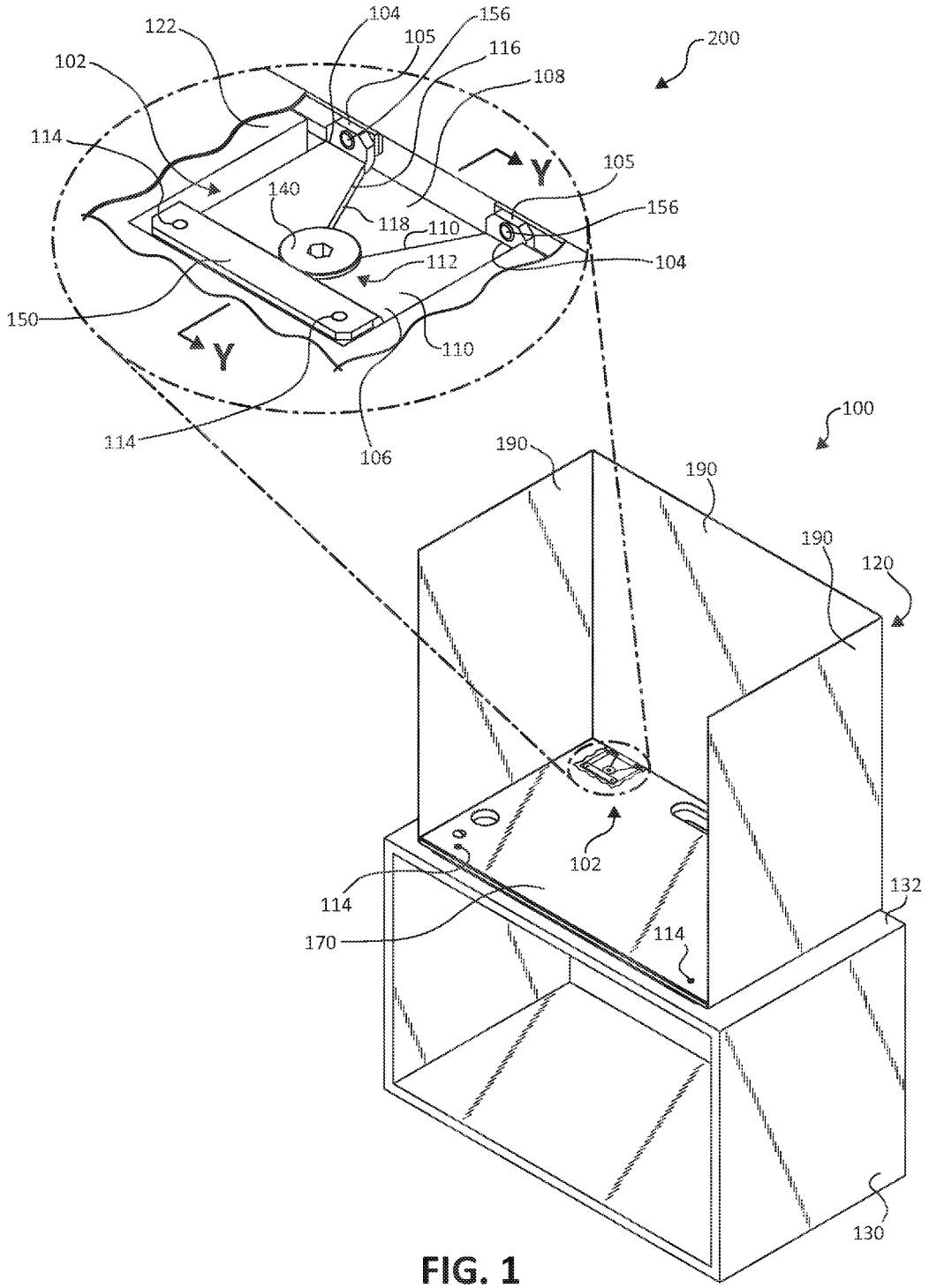
FIG. 1 is a front perspective view illustration, with an enlarged, extracted detail portion of the illustration, of a support structure, gaming cabinet, and a mounting assembly for a gaming device with portions of the gaming cabinet being cut-away to reveal the mounting assembly, according to one embodiment of the present invention.
Figure 2:
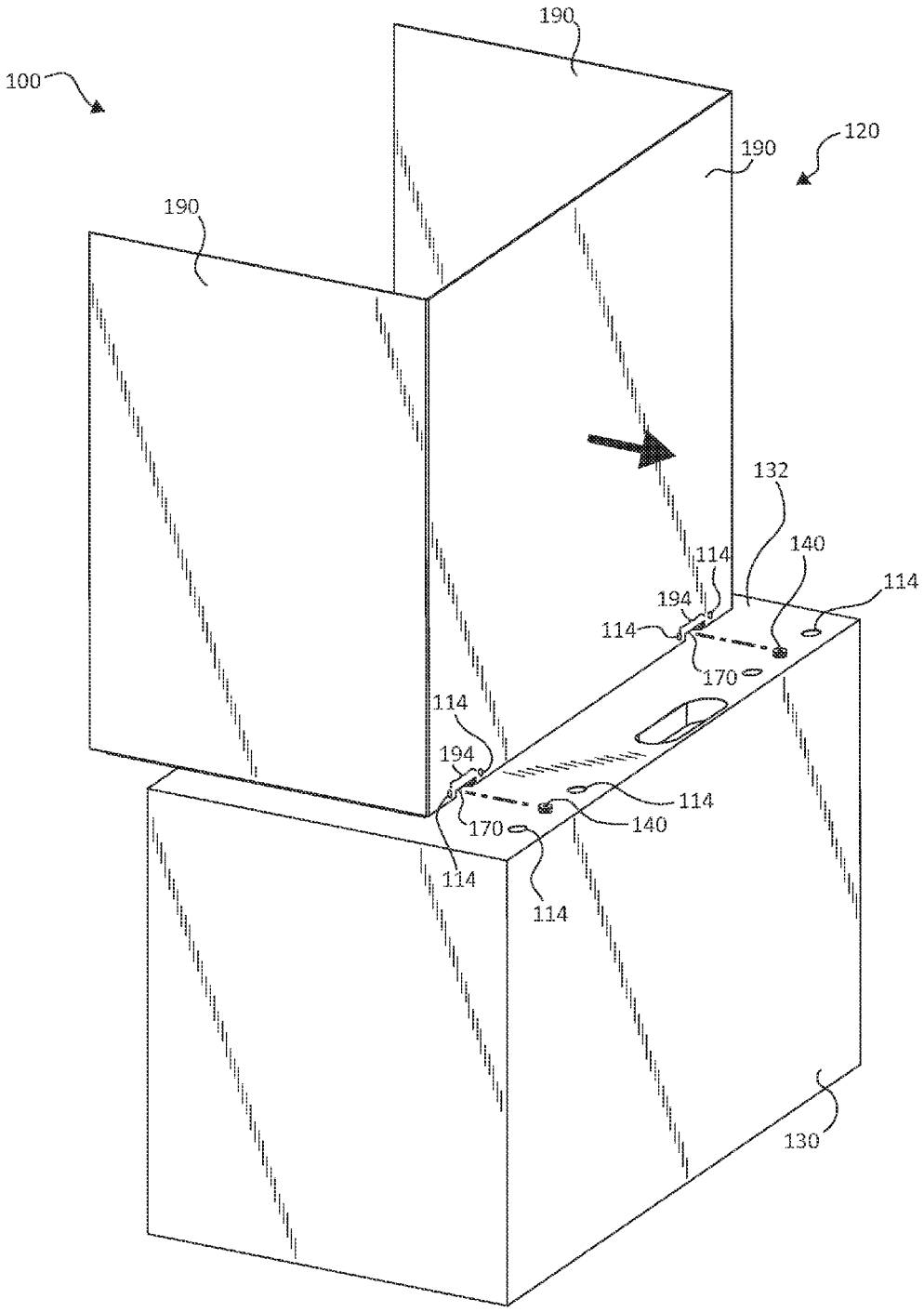
FIG. 2 is a partially exploded, rear perspective view illustration of the support structure, gaming cabinet, and mounting assembly of FIG. 1, according to one embodiment of the present invention.

Turning to the FIGS. 1 and 2, a support structure, gaming cabinet, and a mounting assembly for a gaming device with portions of the gaming cabinet being cut-away to reveal the mounting assembly, is shown. One embodiment of the invention includes a cabinet assembly 100 being formed from a gaming device cabinet 120 and a support platform 130. A mounting assembly 200 includes at least one mounting bracket 102 and a bracket receptor 140 that are each secured to a different one of the cabinet 120 and the support platform 130. For example, as illustrated, at least one mounting bracket 102 is secured to the cabinet 120, and the bracket receptor 140 is secured to the support platform 130.

During construction of cabinet assembly 100, gaming device cabinet 120 is placed on top of support platform 130 in a manner aligning the at least one bracket 120 with the bracket receptor 140. As illustrated in FIG. 2, gaming device cabinet 120 is slid rearwardly as generally indicated by arrow 196 causing the at least one bracket 120 to interact with and selectively couple to the bracket receptor 140 to at least partially secure the gaming device cabinet 120 to the support platform as will be described in additional detail below. Such slidable interaction alleviates difficulties in securing rear portions of the gaming device cabinet 120 to the support platform 130 present in the prior art. In one embodiment illustrated in FIG. 1, and illustrated more clearly in FIG. 2, the support platform 130 is provided with, used together with, and/or connected to the cabinet 120. The cabinet assembly 100 includes at least one mounting bracket 102 and a bracket receptor 140 that are each secured to a different one of the cabinet 120 and the support platform 130. For example, as illustrated in FIGS. 1 and 2, the at least one mounting bracket 102 is secured to the cabinet 120, and the bracket receptor 140 is secured to the support platform 130, such that as the cabinet is sliding on and over the support panel 132, the bracket receptor 140 slides through a cutout 194 to at least partially and/or permanently secure the cabinet 120 to the support platform 130.

Figure 3:
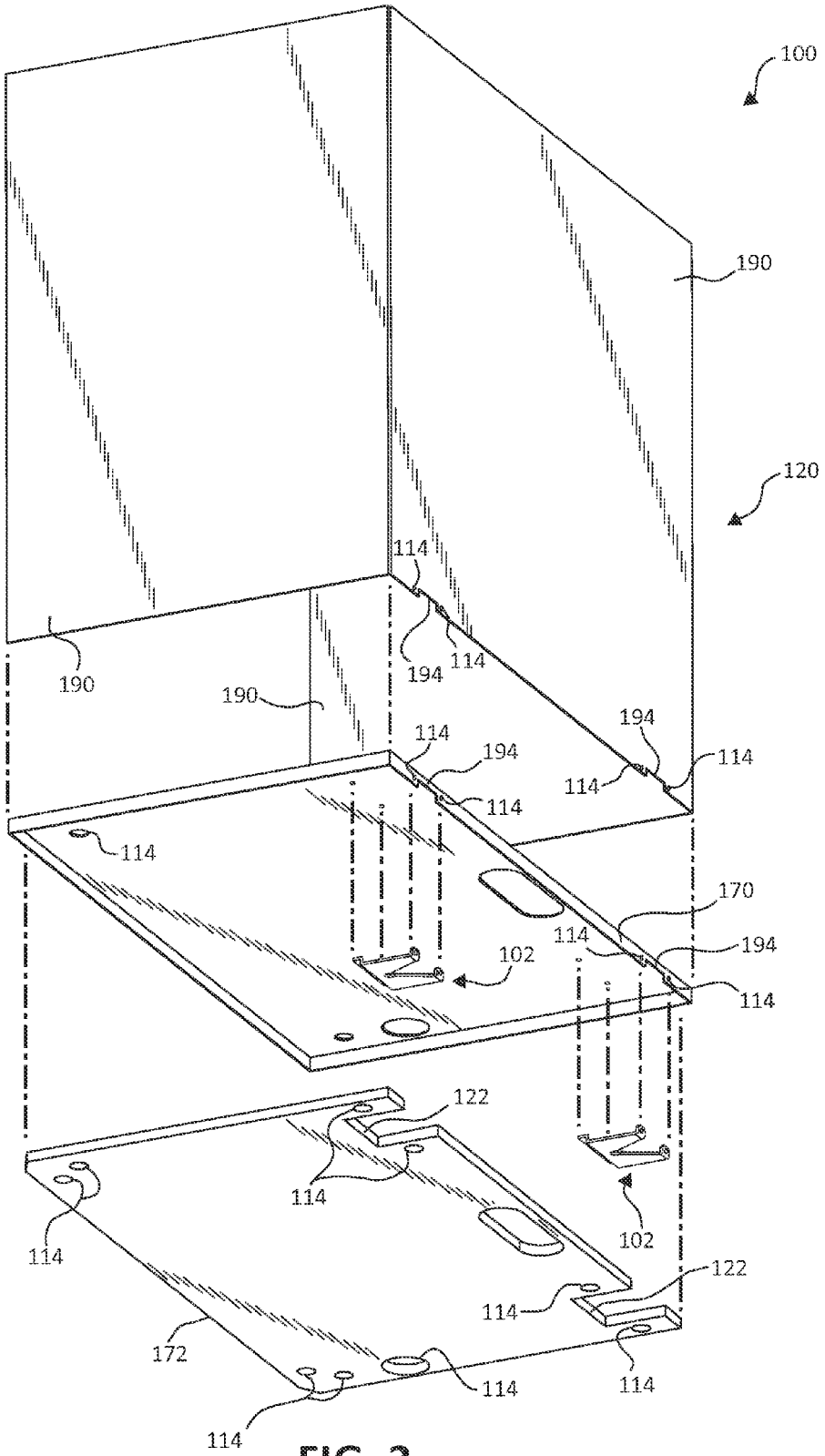
FIG. 3 is an exploded, rear, bottom perspective view illustration of a gaming cabinet, mounting bracket, and support platform of FIG. 1, according to one embodiment of the present invention.

Additionally, referring to FIG. 3, the cabinet 120 includes a base panel 170 and sidewalls 190 extending upwardly from the base panel 170 to house an electronics device (not shown) such as a gaming device. In one embodiment, the base panel 170 is oriented in a substantially horizontal and/or parallel position relative to a floor surface 166, and the sidewalls 190 are oriented in a substantially vertical or perpendicular position relative to a floor surface 166, the support platform 130, and/or cabinet 120. In other words, the sidewalls 190 may be oriented substantially perpendicular to the base panel 170. The cabinet assembly 100 may also include a spacer member 172 (see, e.g., FIG. 3).

The base panel 170, the sidewalls 190, and/or the spacer member 172, illustrated in FIGS. 1-3 are, in one instance, formed from a one or more of variety of materials, such as plastic, wood, steel, or other types of material for securing and encasing an object, such as the gaming device. In other embodiments the base panel 170, the sidewalls 190 and the spacer member 172 may be composed of sheet metal, steel, iron, a high-strength, lightweight alloy material, any metallic material, polyvinyl chloride (PVC) material, carbon fibers, a polyurethane material, a joint metallic and polyurethane material, a dense foam, plastic, carbon fibers, a density fiberboard (MDF), polyurethane material, fibrous materials, rubber materials, or any other material or combination of materials known in the art, which are suitable for such an application. For example, the base panel 170 may be composed of sheet metal and lined with the spacer member 172 being composed of a medium density fiberboard (MDF) for allowing the cabinet 120 to slide and adjust on the support panel 132.

In one embodiment, the base panel 170 and sidewalls 190 may be one continuous piece, which is bent and shaped to protect and cover a particular design of the gaming device, or may be multiple pieces assembled together in such a way to be designed and shaped to cover a particular design of the gaming device. In alternative embodiments, the base panel 170 may be flat and/or planar having various shapes and sizes according to need and preference. In an alternative embodiment, the sidewalls 190 may be flat and/or planar having elongated sections of various sizes. In one embodiment, the base panel 170 and the sidewalls 190 of the cabinet 120 may contain one or more apertures 114, and/or a set of apertures, located in one of a variety of positions on the base panel 170 and the sidewalls. The base panel 170 and the sidewalls 190 of the cabinet further include one or more base panel cutouts 194. The base panel 170 also includes a perimeter flange 192 that surrounds the entire base panel 170 and extends downward and away from the base panel and may be oriented substantially perpendicular from the base panel 170.

FIG. 3 is an exploded, rear, bottom perspective view illustration of a gaming cabinet 120, mounting bracket 102, and support platform of FIG. 1, according to one embodiment of the present invention. The cabinet assembly 100 (FIG. 1) includes at least one of the mounting brackets 102 and a bracket receptor 140 that are each secured to a different one of the cabinet 120 and the support platform 130.

The cabinet 120 includes the base panel 170 and the sidewalls 190 (FIGS. 1 and 2) extending upwardly from the base panel 170 to house an electronics device (not shown), such as a gaming device. In addition to other features and components described in FIGS. 1-2, and 4-6, the cabinet assembly 100 may also include the spacer member 172, more clearly illustrated in FIG. 3. In one embodiment, the spacer member 172 may be flat and/or planar shape having a variety of shapes, sizes, and dimensions. In one embodiment, the spacer member 172 may be of an identical shape and form as the base panel 170, but the dimensions of the spacer member 172 may be smaller than the base panel 170. However, in one embodiment, the thickness of the spacer member 172 is greater than the base panel 170.

The spacer member 172 may contain a first set of apertures 114 located in one of a variety of positions on the spacer member 172. The spacer member 172 may also include one or more spacer member cutouts 122. The spacer member cutouts 122 may be of a variety of lengths and dimensions. In one embodiment, the spacer member cutouts 122 are larger than the base panel cutouts 194. In an alternative embodiment, the spacer member cutouts 122 allow for the mounting brackets 102 to fit within the dimensions of the spacer member cutouts 122. The spacer member 172 may be oriented in a substantially horizontal and/or parallel position relative to a floor surface (not shown), the support platform 130, the base panel 170, and/or the cabinet 120. The sidewalls 190 may be oriented in a substantially vertical or perpendicular position relative to the spacer member 170. In one embodiment, the sidewalls 190 may attach to a base panel 170. The base panel 170 may be connected to the spacer member 172. In one embodiment, the spacer member 172 operates as a shield and protection for the base panel 170, the mounting bracket 102, and/or the gaming device (not shown) while the cabinet 120 is slid onto the support platform 132 (FIG. 2).

Figure 4:
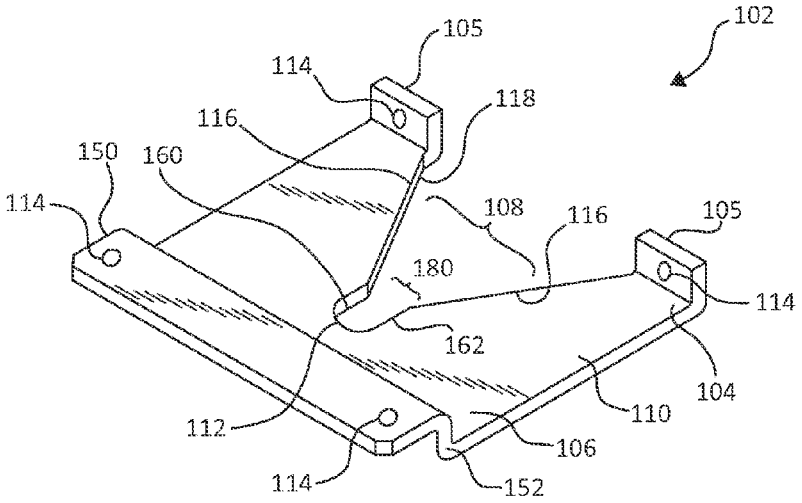
FIG. 4 is a perspective view illustration of the mounting bracket of FIG. 3, according to one embodiment of the present invention.
Figure 5:
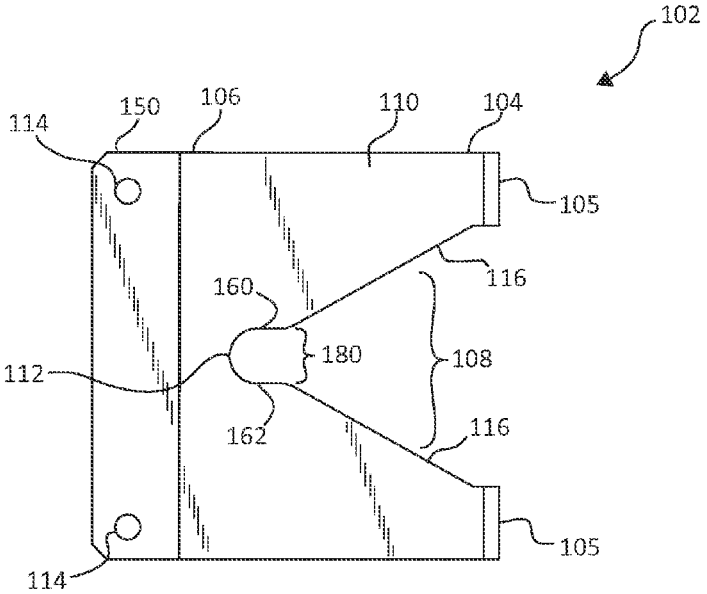
FIG. 5 is a top view illustration of the mounting bracket of FIG. 4, according to one embodiment of the present invention.
Figure 6:
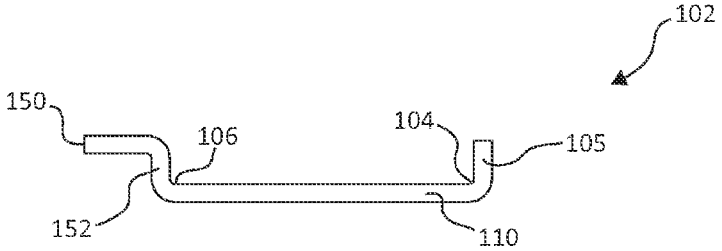
FIG. 6 is a side view illustration of the mounting bracket of FIG. 4, according to one embodiment of the present invention.

Additionally referring to FIGS. 4-6, the mounting bracket 102 includes a substantially planar panel 110 defining a first edge 104, a second edge 106 opposite the first edge 104, a first surface 116, and a second surface 118 opposite the first surface 116. For example, the first edge 104 may be defined as a leading portion of the substantially planar panel 110 and the second edge defined as a trailing portion of the substantially planar panel 110. The substantially planar panel 110 may be of a thickness of a variety of sizes (e.g. greater than or equal to at least 1 millimeter), thus the first surface 116 may be a top portion of the substantially planar panel 110 and the second surface 118 opposite the first surface 116 may be the bottom portion of the substantially planar panel 110. The distance (e.g., the height) between the second surface 118 and the first surface 116 may be defined according to user preference and/or safety requirements.

The substantially planar panel 110 defines a tapered slot 108 open at the first edge 104 to define a slot opening 168 and extending toward the second edge 106. The tapered slot 108 tapers as it extends from the first edge 104 toward the second edge 106 terminating in a slot apex 112 opposite the first edge 104. In one embodiment, the slot apex 112 of the mounting bracket 102 further defines a shaft seat 180 indented from a remainder of the tapered slot 108. For example, rather than slot apex 112 being in the form an intersection between opposing edges of the tapered slot 108, as in other contemplated embodiments of the invention, the mounting bracket 102 defines two substantially linear edges 160, 162 extending further toward second edge 106 capped at and end of each closest to second edge 106. Each of the two substantially linear edges 160, 162 is spaced from and extends substantially parallel to the other of the two substantially linear edges 160, 162.

In one embodiment, the mounting bracket 102 further includes a pair of first flanges 105, each first flange 105 of the pair of first flanges 105 extending substantially perpendicularly to the substantially planar panel 110 from the first edge 104 of the substantially planar panel 110. Each first flange 105 may be positioned on an opposite side of the slot opening 168 of the tapered slot 108 as compared to another first flange 105 in the pair of first flanges 105.

In one example, the mounting bracket 102 includes a second flange 150 and a coupling lip 152. The second flange 150 extends away from the second edge 106 of the substantially planar panel 110, such as, for example, in a direction substantially parallel to each of the first flanges 105. The coupling lip 152 extends opposite and away from the second flange 150 and towards the substantially planar panel 110. In one embodiment, the coupling lip 152 extends in a parallel and/or a perpendicular plane (depending upon the design) as compared to the substantially planar panel 110.

Figure 7:
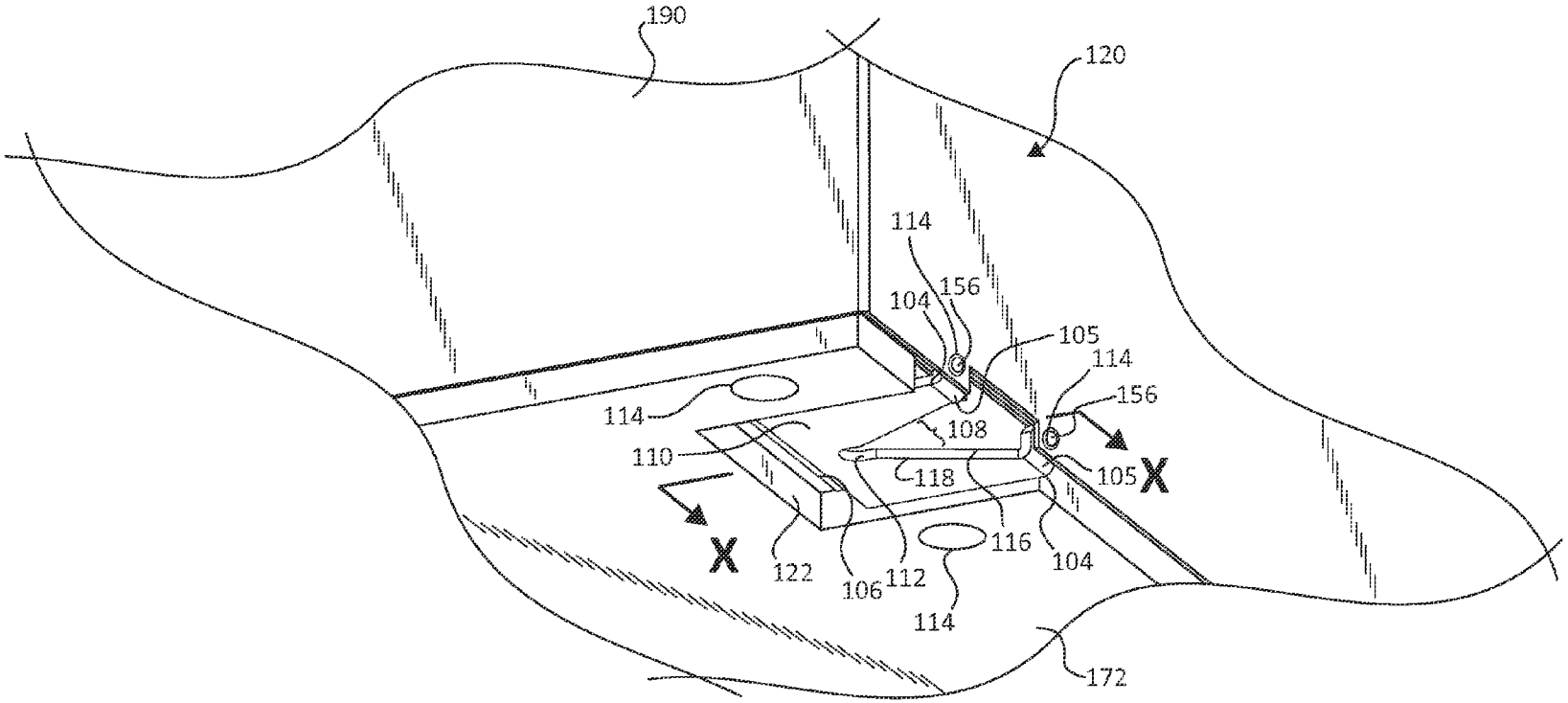
FIG. 7 is a rear, bottom perspective view illustration of a gaming cabinet, mounting bracket, and support platform of FIG. 3, according to one embodiment of the present invention.
Figure 8:
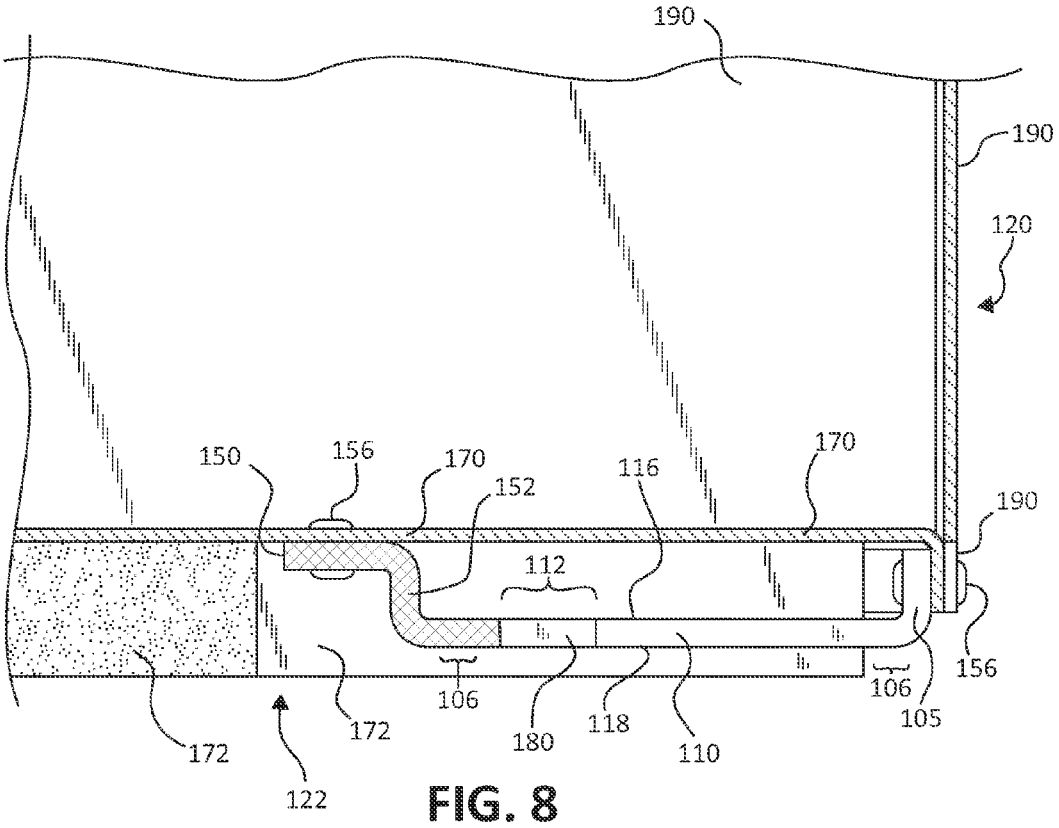
FIG. 8 is an enlarged, perspective cross-sectional view illustration taken along line X-X in FIG. 7, according to one embodiment of the present invention.

FIGS. 7 and 8 illustrate one embodiment of a gaming cabinet 120, mounting bracket 102 (not identified in FIG. 7 or 8), and support platform 130 according to FIGS. 1-3. As illustrated, the at least one mounting bracket 102 is secured to the gaming device cabinet 120. For example, the at least one mounting bracket 102 is secured to the base panel 170, more particularly, to the perimeter flange 192 surrounding a remainder of the base panel 170. The base panel 170 is also attached to the spacer member 172. In one embodiment, the at least one mounting bracket 102 is attached to a rear portion of the base panel 170 of the cabinet 120 at or near the base panel cutouts 194, which is more clearly illustrated in FIG. 3. In one embodiment, the at least one mounting bracket 102 is secured to and extends away from the perimeter flange 192 of the base panel 170 of the cabinet 120. The cabinet 120 further includes the sidewall 190 attached to the base panel 170, for example, the perimeter flange 192 of the base panel 170, and the sidewall 190 extends upwardly from the base panel 170 to house an electronics device (not shown). In one embodiment, the spacer member 172 may be connected to the base panel 170.

More specifically, apertures 114 (FIGS. 1 and 2) are located in a variety of positions on the base panel 170, the spacer member 172, and the sidewalls 190 and are designed to receive fastener member 156 as a means for attachment. In one embodiment, the mounting brackets 102, illustrated most clearly in FIGS. 4 and 6, are secured to and extend away from the base panel 170 of the cabinet 120. In other words, the mounting brackets 102 are attached to a selected portion (e.g., a back rear portion) of the base panel 170 of the cabinet 120 using the fastener members 156.

Further assisting the assembly of the illustrated components, in one embodiment, each first flange 105 of the pair of first flanges 105, the second flange 150, and the coupling lip 152 of the mounting bracket 102 are also designed to receive the fastener members 156. Using each first flange 105 of the pair of first flanges 105 of the mounting bracket 102, the sidewall 190 of the cabinet 120 and the perimeter flange 192 of the base panel 170 are attached to and secured to the mounting bracket 102 using the fastener members 156. The second flange 150 of the mounting bracket 102 extends away from the second edge 106 of the substantially planar panel 110 and attaches to the base panel 170 using other ones of the fastener members 156. The coupling lip 152 of the mounting bracket 102 may also be used for attaching the mounting bracket 102 to the base panel 170 using one of the fastener members 156. The base panel 170 is also coupled to the spacer member 172 using both the apertures 114 located in one of a variety of positions on the base panel 170 and the spacer member 172.

As illustrated in FIGS. 7 and 8, the space member 172 defines spacer member cutouts 122 sized and shaped to allow the mounting brackets 102 to fit within the dimensions of the spacer member cutouts 122. A top portion of the spacer member 172 may be parallel to the base panel 170, and the top portion of the spacer member 172 may be flush with the bottom portion of the base panel 170. In one embodiment, the height (e.g, the thickness) of the spacer member 172 is larger than the height (e.g., thickness) of the perimeter flange 192 of the base panel 170 and of the mounting bracket 102 as it extends away from the base panel 170. As such, with the top portion of the spacer member 172 being flush with the bottom portion of the base panel 170, the bottom portion of the spacer member 172 extends away from the base panel 170 and the cabinet 120 thereby operating as a shield and protection for the base panel 170, the mounting bracket 102, and/or the gaming device (not shown) while the cabinet 120 is slid onto and/or removed from the support platform 132 (FIG. 2).

Figure 9:
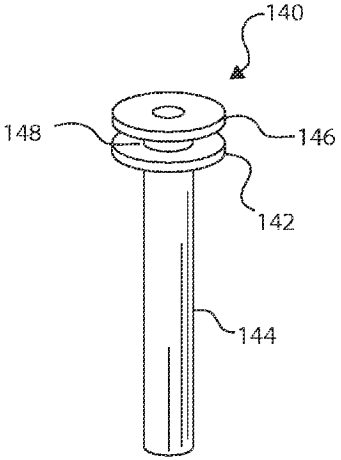
FIG. 9 is a perspective view illustration of a bracket receptor of the mounting assembly of FIG. 1, according to one embodiment of the present invention.

FIG. 9 is a perspective view illustration of a bracket receptor 140 of the mounting assembly 200 of FIG. 1, according to one embodiment of the present invention. In one embodiment, a bracket receptor 140 includes a plate 142 and a shaft 144 extending from the plate 142. The plate 142 extends beyond one or more sides of the shaft 144. The shaft 144 may be of a variety of shapes and size and threaded and/or unthreaded based upon the type of cabinet 120 (FIG. 1) and support platform 130 (FIG. 1). The bracket receptor 140 further comprises an annular projection (which may be one of a variety of shapes and sizes and may be similar in shape, size, and functionality as the plate 142) 146 extending about the shaft 144 and spaced from the plate 142 (which may be one of a variety of shapes and sizes and may be similar in shape, size, and functionality as the annular projection 146) to define a bracket reception zone 148 between the plate 142 and the annular projection 146. In one example, the bracket reception zone 148 has a height defined between the plate 142 and the annular projection 146 that is greater than a thickness of the substantially planar panel 110 of the mounting bracket 102.

In one embodiment, the bracket receptor 140 may be a bolt or pin machined from stock steel rods or die casted to form a bolt (e.g., a 5/16-18 bolt) with a double platform (e.g., the plate 142 and the annular projection 146) and a variety of shaped socket heads (e.g., a hexagonal socket head). In one embodiment, the double platform (e.g., the plate 142 and the annular projection 146) of the bolt (e.g., the bracket receptor 140) acts as the connection for the mounting brackets 102. The plate 142 sits on top of the support platform 130 (FIG. 1), while the annular projection 146 prevents the cabinet 120 from tipping, shaking, rocking, or moving when fully engaged. The shaft 144 (more specifically the bracket reception zone 148) in between the plate 142 and the annular projection 146 prevents the base panel 170 from moving past a desired location for the cabinet 120.

Figure 12:
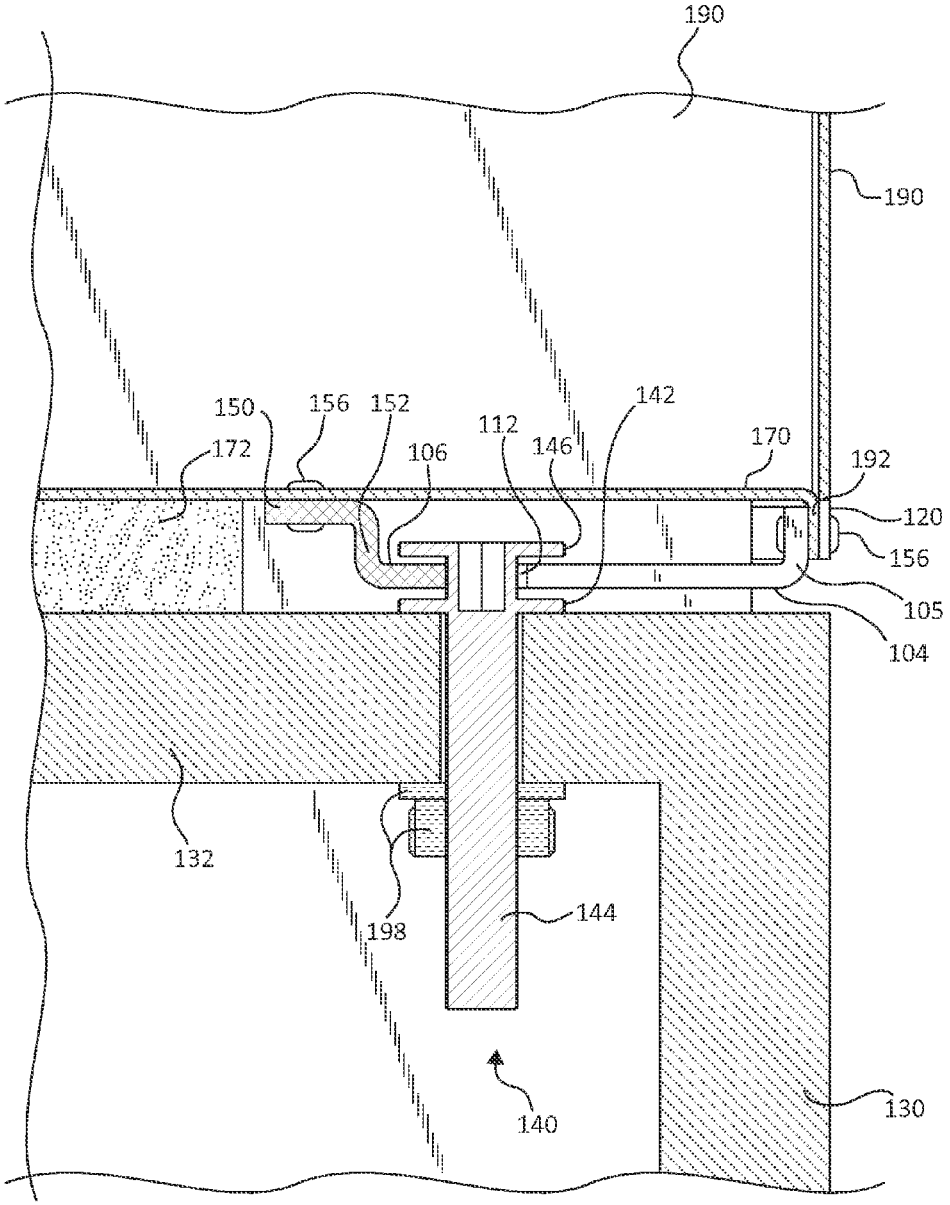
FIG. 12 is an enlarged cross-sectional view illustration taken along line Y-Y of FIG. 1, but without the cutouts of FIG. 1, according to one embodiment of the present invention.

In one embodiment, as more clearly illustrated in FIG. 12, at least one type of locking mechanism 198 may be employed for securing and locking down the bracket receptor 140 to the support panel 132. In one embodiment, the locking mechanism 198 is a nut and may contain a washer and is selectively tightened. In other words, the locking mechanism 198 allows for the bracket receptor 140 to be secured to the support panel 132 so that the plate 142 of the bracket receptor 140 is flush and tight against the support panel 132.

Figure 10:
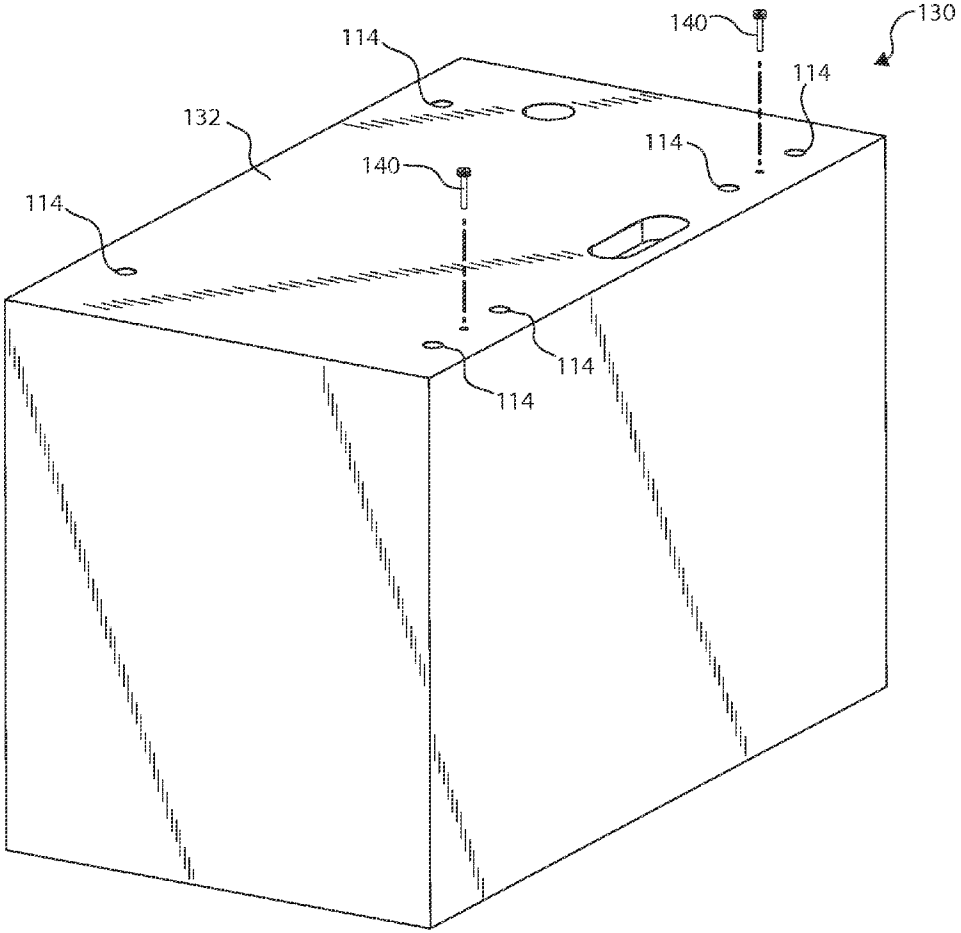
FIG. 10 is a partially exploded, rear perspective view illustration of a bracket receptor of the mounting assembly and a support platform of FIG. 2, according to one embodiment of the present invention.

FIG. 10 is a partially exploded, rear perspective view illustration of a bracket receptor 140 of the mounting assembly (e.g., system) 200 and a support platform 130 of FIG. 2, according to one embodiment of the present invention. The support platform 130 includes a support panel 132. The support panel 132 may contain apertures 114, each configured to receive the fastener members 156 (FIG. 8), located in one of a variety of positions on the support panel 132, for example, near a rear edge of the support panel. In one embodiment, each bracket receptor 140 is secured to and extends away from the support panel 132 of the support platform 130.

Figure 11:
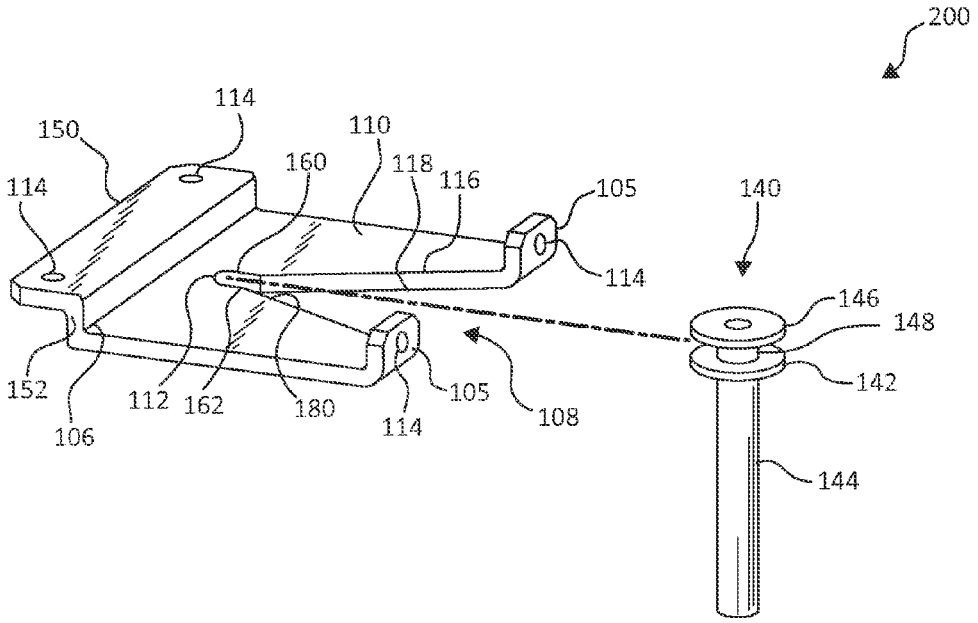
FIG. 11 is a rear, top perspective view illustration of the bracket receptor interaction with the mounting bracket of the mounting assembly of FIG. 1 with the cabinet and support platform removed for clarity, according to one embodiment of the present invention.

FIG. 11 illustrates, in one exemplary embodiment, the bracket receptor 140 (see FIG. 9 140) interactions with the mounting bracket 102 (see FIG. 4 102) of the mounting assembly/system 200 of FIG. 1, with the cabinet 120 and support platform 130 removed for clarity. Referring to FIG. 11 in combination with the cross-sectional view of FIG. 12, during assembly, the shaft 144 of the bracket receptor 140 is selectively aligned with the slot opening 168, and the mounting bracket 102 is advanced toward the bracket receptor 140 moving shaft 144 through the tapered slot 108 and into the slot apex 112, and in one embodiment, the shaft seat 180 between the two substantially linear edges 160,162. When the shaft 144 (more specifically the bracket reception zone 148) is placed within the shaft seat 180, the substantially planar panel 110 is secured between the plate 142 and the annular projection 146 within the bracket reception zone 148 to selectively secure the mounting bracket 102 (see FIG. 4 102) in place relative to the bracket receptor 140. The narrow opening of the shaft seat 180 snugly receives the shaft 144 of the bracket receptor 140 limiting undesired lateral translation of the bracket receptor 140 and any structure attached thereto (e.g., the support platform 130) relative to the mounting bracket 102 and any structure attached to the mounting bracket 102 (e.g., the cabinet 120). In one embodiment, subsequent interaction between the substantially planar panel 110 and each of the plate 142 and the annular projection 146 limits rotation of one of the mounting bracket 102 and the bracket receptor 140 relative to one another.

In one embodiment, the bracket receptor 140, includes the plate (e.g., in this example the plate may either be the plate 142 and/or the annular projection 146) and the shaft 144 extending from the plate. The plate (e.g., in this example the plate may either be the plate 142 and/or the annular projection 146) extends beyond one or more sides of the shaft 144. The shaft 144 of the bracket receptor 140 is selectively positioned within the slot apex 112 of the mounting bracket 102 such that the plate (e.g., in this example the plate may either be the plate 142 and/or the annular projection 146) of the bracket receptor 140 is positioned adjacent the first surface 116 of the substantially planar panel 110 and the shaft 144 of the bracket receptor 140 extends beyond the second surface 118 of the substantially planar panel 110.

Recalling that during interaction between the mounting bracket 102 and the bracket receptor 140, the mounting bracket 102 is coupled with the cabinet 120 and the bracket receptor 140 is coupled with the support platform 130 (or vice versa) as illustrated in FIGS. 1, 2, and 12, for example, the described structures provide further advantages. For instance, during installation of cabinet 120 on support platform 130, the cabinet 120 is placed on support platform 130 and roughly aligned with support platform by placing the one or more cutouts 194 in the cabinet 120 to generally align with the bracket receptor 140 on support platform 130. Linear movement or sliding of the cabinet 120 into place causes the mounting bracket 102 to move such that the shaft 144 of the bracket receptor 102 enters the slot opening 168 through the one or more cutouts 194 in the cabinet 120. Continued sliding of the cabinet 120 results in the shaft 144 of the bracket receptor 102 interfacing with opposing edges of the tapered slot 108 to more particularly laterally align the cabinet 120 with the support platform 130 as the bracket receptor 102 slides along the edges of the tapered slot 108 toward the shaft seat 180. Finally, the shaft 144 of the bracket receptor 102 slides into the slot apex 112 and sets into the shaft seat 180 to at least partially secure the cabinet 120 to the support platform 130. While the bracket receptor 140 is set into the shaft seat 180 during installation, after installation, and prior to removal, the bracket receptor 140 keeps both the cabinet 120 from tipping, rocking, swaying, and/or moving on the support platform 130. In other words, while the bracket receptor 140 is set into the shaft seat 180 the cabinet 120 and the support platform 130 are stabilized and safe for use after a minimum of one front fastener (e.g., carriage bolt) is added.

In one embodiment, the cabinet 120 and the support platform 130 may additionally be secured to one another near a front side of each opposite the mounting assembly 200. While the additional securement maybe be accomplished with components similar to the mounting assemblies 200, additional fasteners may alternatively be used particularly because the front sides of the cabinet and the support platform 130 are more easily accessed once the cabinet 120 is finally positioned on the support platform 130.

Thus, as described above, the cabinet assembly 100 (FIG. 1) for a gaming device incorporates one or more bracket receptors 140 or set of other suitable bracket receptors 140 mounted on a rear section of the gaming device base panel 170. Using one or more of the mounting brackets 102 located on a cabinet 120, which secures and encases the gaming device (not shown), the cabinet 120 with the gaming device secured therein is lifted, is positioned on the gaming device platform 130, and slid back causing the one or more of the mounting brackets 102 to receive the one or more bracket receptors 140 or set of other suitable bracket receptors 140. When the one or more of the mounting brackets 102 are slid fully around a respective one of the one or more bracket receptors 140 or set of other suitable bracket receptors 140, the cabinet 120 is at least partially secured to the gaming device platform 130. In the above-described manner, the time required for installation, removal, and/or accessing the gaming device for repair/maintenance time is reduced to less than two or three minutes. Although the mounting brackets 102 and the one or more bracket receptors 140 or set of other suitable bracket receptors 140 are primarily described above as being coupled to the cabinet 120 and the gaming device platform 130, respectively, in other embodiments, the one or more mounting brackets 102 are secured to the gaming device platform 130, and the one or more bracket receptors 140 or set of other suitable bracket receptors 140 are secured to the cabinet.

In one embodiment, the above-describe installation allows the cabinet 120 to be secured to the support platform 130 without requiring tools for securing the cabinet 120 to the platform 130. However, as needed, a tool use may be required for one or more fastener/bolt and/or a final front fastener/bolt. The one or more bracket receptors 140 or set of other suitable bracket receptors 140, while secured in the one or more mounting brackets 102, eliminate the need for removal of any supporting equipment, such as the aforementioned power supplies, CPU modules, hoppers, and power distribution components, etc., from the cabinet in order to install, secure, repair, and remove the gaming devices, due to the positioning of the mounting brackets on the base panel 170 and spacer member 172 thereby allow the cabinet to be slid on and off the support platform.

Figure 13:
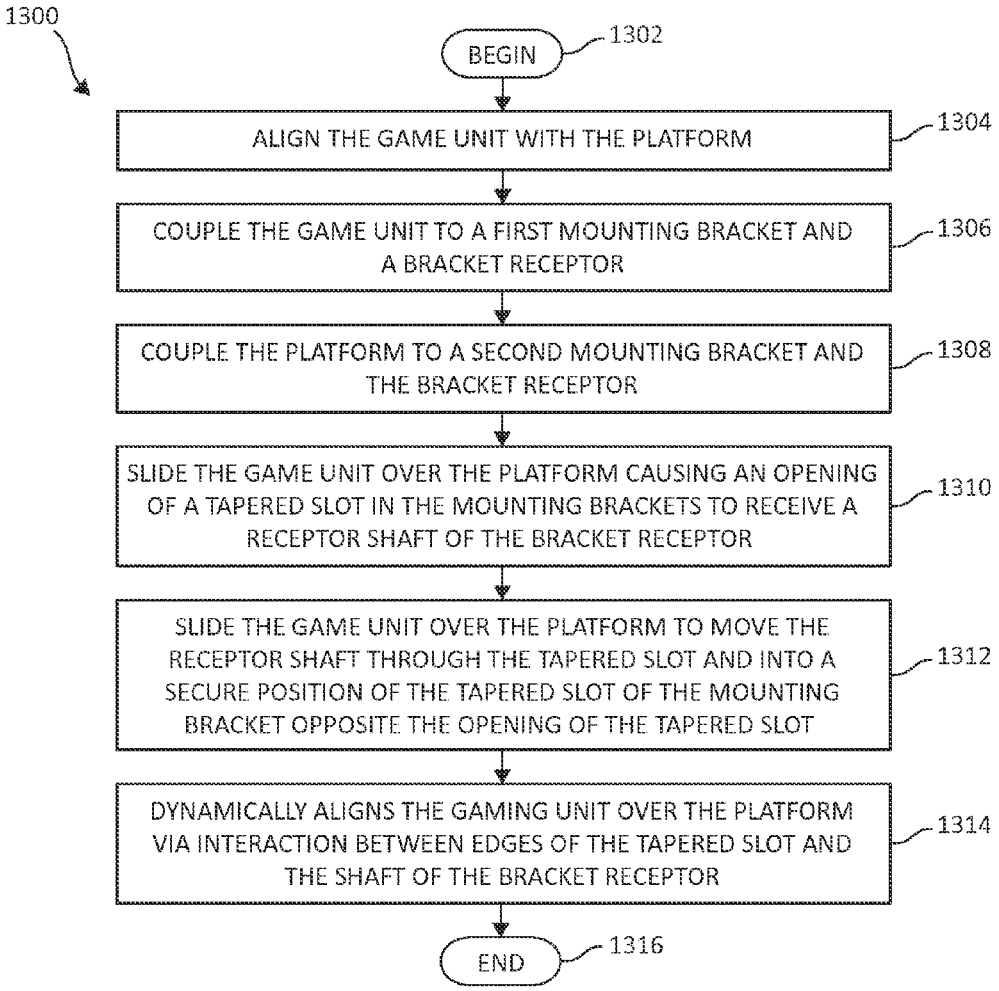
FIG. 13 is flow chart illustrating an exemplary method for coupling a game unit to a platform.

FIG. 13 is flow chart illustrating an exemplary method 1300 for coupling a game unit to a platform. The method 1300 begins (step 1302) by aligning the game unit with the platform (step 1304). The game unit is coupled to a first mounting bracket and a bracket receptor (step 1306). The first mounting bracket may be coupled to a defined portion of the game unit (e.g., coupled to a bottom rear portion of the game unit). The platform is coupled to a second mounting bracket and the bracket receptor (step 1308). The method 1300 slides the game unit over the platform causing an opening of a tapered slot in the mounting brackets to receive a receptor shaft of the bracket receptor (step 1310). The method 1300 continues sliding the game unit over the platform to move the receptor shaft through the tapered slot and into a secure position of the tapered slot of the mounting bracket opposite the opening of the tapered slot (step 1312). In other words, the mounting bracket is positioned to the receptor shaft of the bracket receptor via the slot apex having a shaft seat that defines two substantially linear edges spaced from one another and the shaft seat indented from a remainder of the tapered slot for selectively securing the mounting bracket in place relative to the bracket receptor. During the continuous sliding operation, the method 1300 dynamically aligns the gaming unit over the platform via interaction between edges of the tapered slot and the shaft of the bracket receptor (step 1314). The method ends (step 1316).

Although the invention has been described with respect to particular embodiments, such embodiments are meant for illustrative purposes only and should not be considered to limit the invention. Various alternatives and changes will be apparent to those of ordinary skill in the art upon reading this application. Other modifications within the scope of the invention and its various embodiments will be apparent to those of ordinary skill.

What is claimed is:

1. A mounting assembly comprising:

a mounting bracket comprising a substantially planar panel defining a first edge, a second edge opposite the first edge, a first surface, and a second surface opposite the first surface, and wherein the substantially planar panel defines a tapered slot open at the first edge, extending from the first edge toward the second edge, and terminating in a slot apex opposite the first edge, the mounting bracket further includes a flange and a coupling lip, the flange extends away from the second edge of the substantially planar panel, and the coupling lip extends away from the second edge opposite the substantially planar panel in a manner substantially parallel to the substantially planar panel; and a bracket receptor comprising an annular projection and a shaft extending from the annular projection, the annular projection extending beyond one or more sides of the shaft; and wherein the shaft of the bracket receptor is selectively positioned within the slot apex of the mounting bracket such that the annular projection of the bracket receptor is positioned adjacent the first surface of the substantially planar panel and the shaft of the bracket receptor extends beyond the second surface of the substantially planar panel, and wherein the bracket receptor further comprises a plate extending about the shaft and spaced from the annular projection such that, when the shaft of the bracket receptor is positioned within the slot apex, the plate is positioned adjacent the second surface of the substantially planar panel, wherein a bracket reception zone is defined between the plate and the annular projection for receiving the mounting bracket via the slot apex.

2. A mounting assembly as defined in claim 1, wherein the mounting bracket is configured to be secured to a cabinet, and the mounting bracket further comprises a pair of first flanges, each first flange of the pair of first flanges extending substantially perpendicularly to the substantially planar panel from the first edge of the substantially planar panel to space the tapered slot from the cabinet, and wherein each first flange is positioned on an opposite side of the tapered slot as compared to another first flange in the pair of first flanges.

3. A mounting assembly as defined in claim 1, wherein the coupling lip defines one or more apertures, each configured to receive a fastener member.

4. A mounting assembly as defined in claim 1, wherein the slot apex includes a shaft seat indented from a remainder of the tapered slot, the shaft seat defines two substantially linear edges spaced from one another, and the shaft of the bracket receptor is selectively positioned between the two substantially linear edges to selectively secure the mounting bracket in place relative to the bracket receptor.

5. A mounting assembly as defined in claim 1, in combination with a cabinet and a support platform, and wherein the cabinet includes a base panel, the support platform includes a support panel, and at least one of the mounting bracket and the bracket receptor is secured to and extends away from each of the base panel of the cabinet and the support panel of the support platform, such that as the cabinet is slid over the support panel, the shaft of the bracket receptor slides through the tapered slot and into the slot apex to at least partially secure the cabinet to the support platform.

6. A combination as defined in claim 5, wherein a spacer member is secured to the base panel of the cabinet and includes an aperture accommodating the one of the mounting bracket and the bracket receptor that is secured to the support panel, wherein the spacer member maintains the base panel spaced from the support panel when the cabinet is secured to the support platform.

7. A combination as defined in claim 5, wherein the base panel defines a coupling lip, the cabinet further includes a sidewall extending upwardly from the base panel to house an electronics device, and the sidewall is secured to the coupling lip of the base panel.

8. A combination as defined in claim 7, wherein the mounting bracket is secured to the base panel at least partially via the coupling lip.

9. A combination as defined in claim 8, wherein each of the base panel and the sidewall includes a cutout aligned with the tapered slot at the first edge of the mounting bracket such that the bracket receptor slides through the cutouts formed by the base panel and the sidewall to enter the tapered slot when the cabinet is slid over the support panel.

10. A combination as defined in claim 7, wherein the electronics device is a gaming machine.

11. A combination as defined in claim 5, wherein the mounting bracket is secured to the base panel, and the bracket receptor is secured to the support panel.

12. A game presentation structure:

a gaming assembly including a base panel;

a platform supporting the gaming assembly, the platform including a support panel;

a mounting bracket defining a first edge, a second edge opposite the first edge, and a tapered slot open at the first edge, extending from the first edge toward the second edge, and terminating in a slot apex opposite the first edge, and wherein the mounting bracket is coupled to a first one of the base panel of the gaming assembly and the support panel of the platform, the mounting bracket further includes a flange and a coupling lip, the flange extends away from the second edge of the substantially planar panel, and the coupling lip extends away from the second edge opposite the substantially planar panel in a manner substantially parallel to the substantially planar panel;

a bracket receptor comprising an annular projection and a shaft extending from the annular projection, the annular projection extending beyond one or more sides of the shaft, and wherein the bracket is coupled to and extends away from a second one of the base panel of the gaming assembly and the support panel of the platform; and wherein the gaming assembly and the platform are coupled to one another by sliding the base panel of the gaming assembly over the support panel of the platform to move the shaft of the bracket receptor into and through the tapered slot to the slot apex of the tapered slot to at least partially couple the gaming assembly to the platform, and during movement of the shaft of the bracket receptor through the tapered slot and upon placement of the shaft of the bracket receptor into the slot apex, the annular projection is positioned between the mounting bracket and the first one of the base panel of the gaming assembly and the support panel of the platform, wherein the bracket receptor further comprises a plate extending about the shaft and spaced from the annular projection such that, when the shaft of the bracket receptor is positioned within the slot apex, the plate is positioned adjacent the mounting bracket opposite the annular projection, wherein a bracket reception zone is defined between the plate and the annular projection for receiving the mounting bracket via the slot apex.

13. A game presentation structure as defined in claim 12, wherein the slot apex includes a shaft seat indented from a remainder of the tapered slot, the shaft seat defines two substantially linear edges spaced from one another, and the shaft of the bracket receptor is selectively positioned between the two substantially linear edges to selectively secure the mounting bracket in place relative to the bracket receptor.

14. An apparatus, the apparatus comprising:

a platform;

a game unit aligned with the platform, the game unit being coupled to a first one of a mounting bracket and a bracket receptor, and the platform being coupled to a second one of the mounting bracket and the bracket receptor, wherein the first one of mounting bracket comprises a substantially planar panel defining a first edge, a second edge opposite the first edge, a first surface, and a second surface opposite the first surface, and wherein the substantially planar panel defines a tapered slot open at the first edge, extending from the first edge toward the second edge, and terminating in a slot apex opposite the first edge, the mounting bracket further includes a second flange and a coupling lip, the second flange extends away from the second edge of the substantially planar panel, and the coupling lip extends away from the second edge opposite the substantially planar panel in a manner substantially parallel to the substantially planar panel, wherein:

the game unit positioned over the platform such that an opening of a tapered slot in the mounting bracket receives a receptor shaft of the bracket receptor into a secure position of the tapered slot of the mounting bracket opposite the opening of the tapered slot; and the game unit is aligned over the platform via interaction between edges of the tapered slot and the shaft of the bracket receptor, wherein the bracket receptor further comprises a plate extending about the shaft and spaced from the annular projection such that, when the shaft of the bracket receptor is positioned within the slot apex, the plate is positioned adjacent the mounting bracket opposite the annular projection, wherein a bracket reception zone is defined between the plate and the annular projection for receiving the mounting bracket via the slot apex.

15. The apparatus as defined in claim 14, wherein the first one of the mounting bracket and the bracket receptor is coupled to a bottom portion of the game unit.

16. The apparatus as defined in claim 15, wherein the mounting bracket to the receptor shaft of the bracket receptor via the slot apex having a shaft seat that defines two substantially linear edges spaced from one another and the shaft seat indented from a remainder of the tapered slot for selectively securing the mounting bracket in place relative to the bracket receptor.

17. The apparatus as defined in claim 14, wherein the mounting bracket is selectively positioned to the receptor shaft of the bracket receptor via a slot apex of the tapered slot for selectively securing the gaming unit to the platform.

* * * * *